United States Patent [19]

Kristensson

[11] Patent Number: 4,558,466

[45] Date of Patent: Dec. 17, 1985

[54] VEST FOR USE IN POLLUTED ATMOSPHERE

[76] Inventor: Jan A. A. Kristensson, Syrenvägen 1, S-262 00 Ängelholm, Sweden

[21] Appl. No.: 520,506

[22] Filed: Aug. 4, 1983

[30] Foreign Application Priority Data

Aug. 5, 1982 [SE] Sweden ..... 8204591

[51] Int. Cl.[4] ..... A41D 13/00

[52] U.S. Cl. ..... 2/2; 2/8; 2/DIG. 1

[58] Field of Search ..... 2/1, 2, 102, DIG. 1

[56] References Cited

U.S. PATENT DOCUMENTS 3,921,223 11/1975 Hoyecki ..... 2/DIG. 1
3,922,722 12/1975 Pokhodnya ..... 2/8
4,194,247 3/1980 Melander ..... 2/2
4,195,363 4/1980 Jenson ..... 2/DIG. 1

FOREIGN PATENT DOCUMENTS 3043027 6/1982 Fed. Rep. of Germany .

*Primary Examiner*—Louis K. Rimrodt
*Attorney, Agent, or Firm*—Staas & Halsey

[57] ABSTRACT

The present invention relates to a vest for use in a polluted atmosphere. The vest is intended to create a fresh air zone outside the vest. To this end, the vest has an air-permeable portion extending around at least a part of the vest, preferably around the entire vest, and a supply air connection for supplying fresh air to the interior of the vest and out through said air-permeable portion.

4 Claims, 3 Drawing Figures

VEST FOR USE IN POLLUTED ATMOSPHERE

BACKGROUND OF THE INVENTION

The present invention relates to a vest for use in a polluted atmosphere.

In many industrial jobs and elsewhere workers are compelled to inhale pollutants of various types. A close study of the changes of indoor temperature for one year shows that it is often difficult to create, with conventional ventilation techniques, a satisfactory climate during the entire year. It is not possible to guarantee an acceptable climate with one system only. A ventilation system based upon the "cold air principle" with laminar air injection must comprise a complementary heating system. This solution is always expensive, and its practical application frequently is difficult. Furthermore, the result deteriorates because persons who are moving about in the ventilated environment themselves interfere with the air currents and create turbulence so that pollutants will enter their breathing zone.

Protective masks of various types are often regarded as uncomfortable and are used only in really oppressive environments.

Today, there is available on the market a visored helmet where air is injected inside the visor via a compressed air hose or by means of a fan mounted on the helmet. The air flowing past the wearer's face may, however, feel unpleasant and may irritate the eyes.

SUMMARY OF THE INVENTION

It is the object of this invention to provide a device capable of creating, in a simple, inexpensive and neat manner, a fresh air zone around a persons working area having a polluted atmosphere, and in a manner such that he will not be inconvenienced by the fresh air supplied.

According to the invention, this object is achieved by means of a vest having the characteristic features stated in the appended claims.

BRIEF DESCRIPTION OF THE DRAWINGS

An embodiment of the invention will now be described in detail below, reference being had to the accompanying drawings in which.

DETAILED DESCRIPTION OF THE PREFERRED EMBODIMENTS

Figure 1:
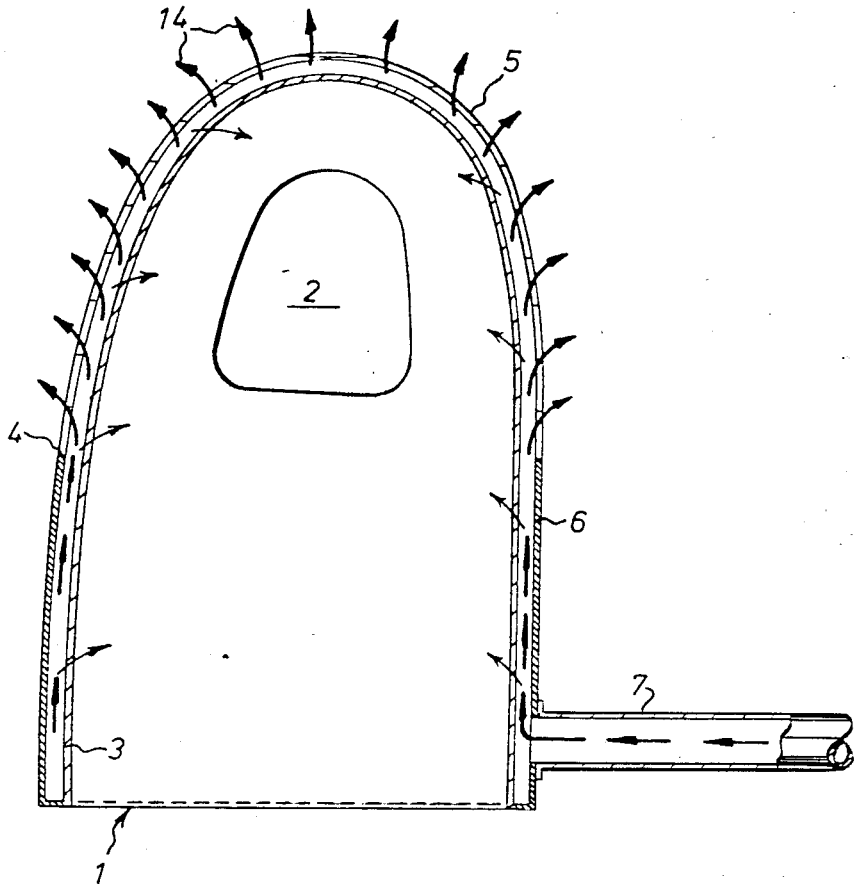
FIG. 1 is a sectional view along line I—I in FIG. 2, of a vest according to the invention.

FIG. 1 is a vertical sectional view of a vest 1 according to the invention, said vest comprising an inner layer 3 of low permeability to air and an outer layer 4 having an upper air-permeable portion 5 and a lower air-tight portion 6. An air supply connection 7 is mounted in the air-tight portion 6 of the outer layer 4. A hose (not shown) from an air supply unit may be connected in some suitable manner to the air supply connection 7. FIG. 1 also shows one arm-hole 2 of the vest.

The air-permeable portion 5 consists of a material having a high resistance to air, whereby the air discharged through this portion will be adequately distributed around the entire upper part of the body of the person wearing the vest. In the embodiment illustrated, the air-permeable portion extends around the entire upper part of the vest, which is preferable to this portion covering only the front of the vest. By discharging fresh air around the entire upper part of the wearer's body, the risk that any gases behind the wearer are sucked into the zone in front of him, will be greatly reduced. Furthermore, he can move about more quickly, especially turn round, if the fresh air zone established by the outflowing air extends around his entire body.

The gap which is formed between the inner layer 3 and the air-tight portion 6 of the outer layer 4 forms an air distribution zone for the air supply 14 (FIG. 2) from the air supply connection 7. The air will thus be distributed around the vest before it escapes through the air-permeable portion 5, and it will be appreciated that the provision of the air distribution zone contributes to a uniform distribution of the air supply 14 around the vest.

Naturally, the vest will function just as well if the inner layer is air-tight, but a partially air-permeable layer will contribute to reducing excess heat between the vest and the wearer's body.

Figure 2:
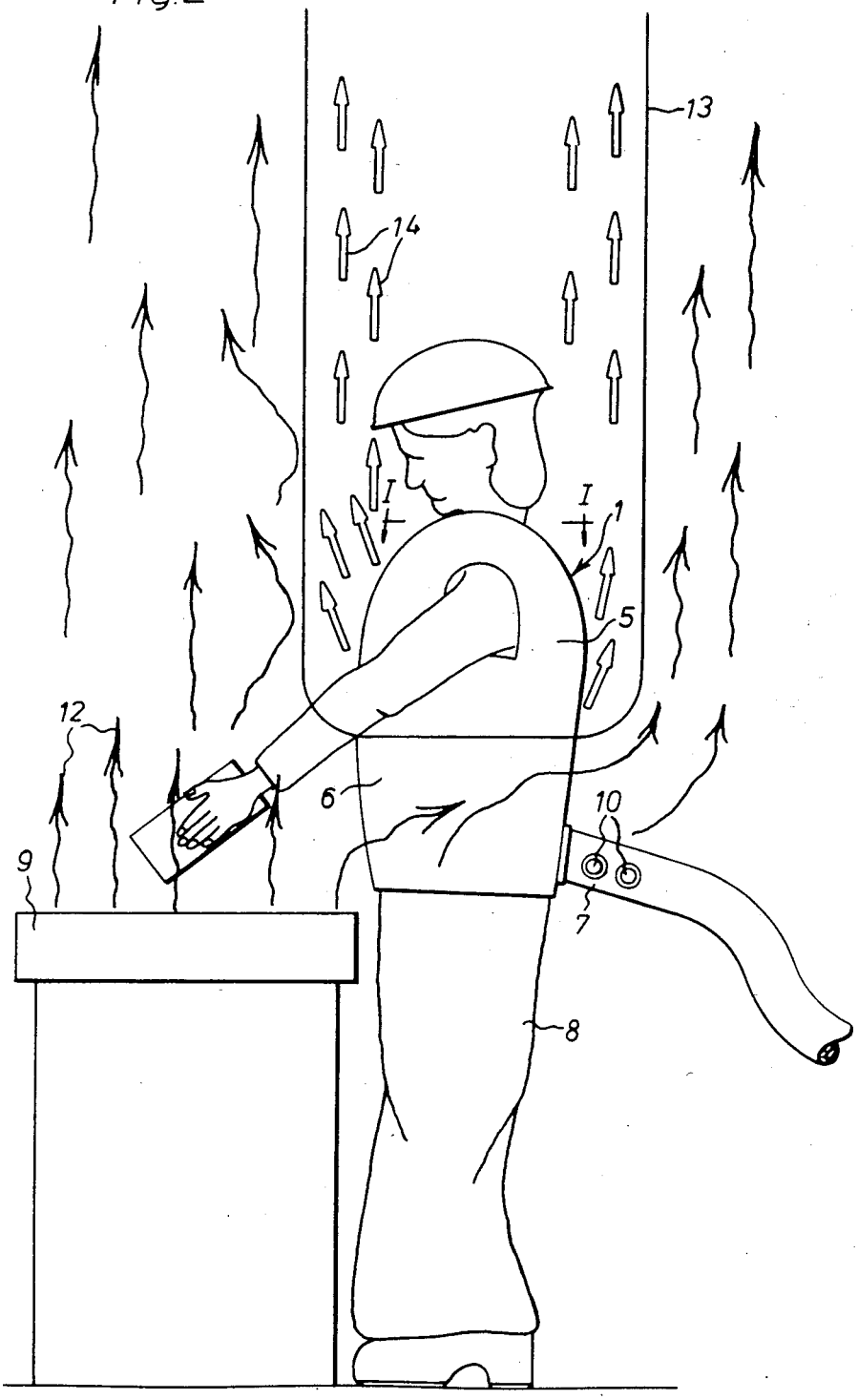
FIG. 2 illustrates the use of a vest according to the invention at an ambient temperature which is lower than the temperature of the fresh air discharged from the vest.
Figure 3:
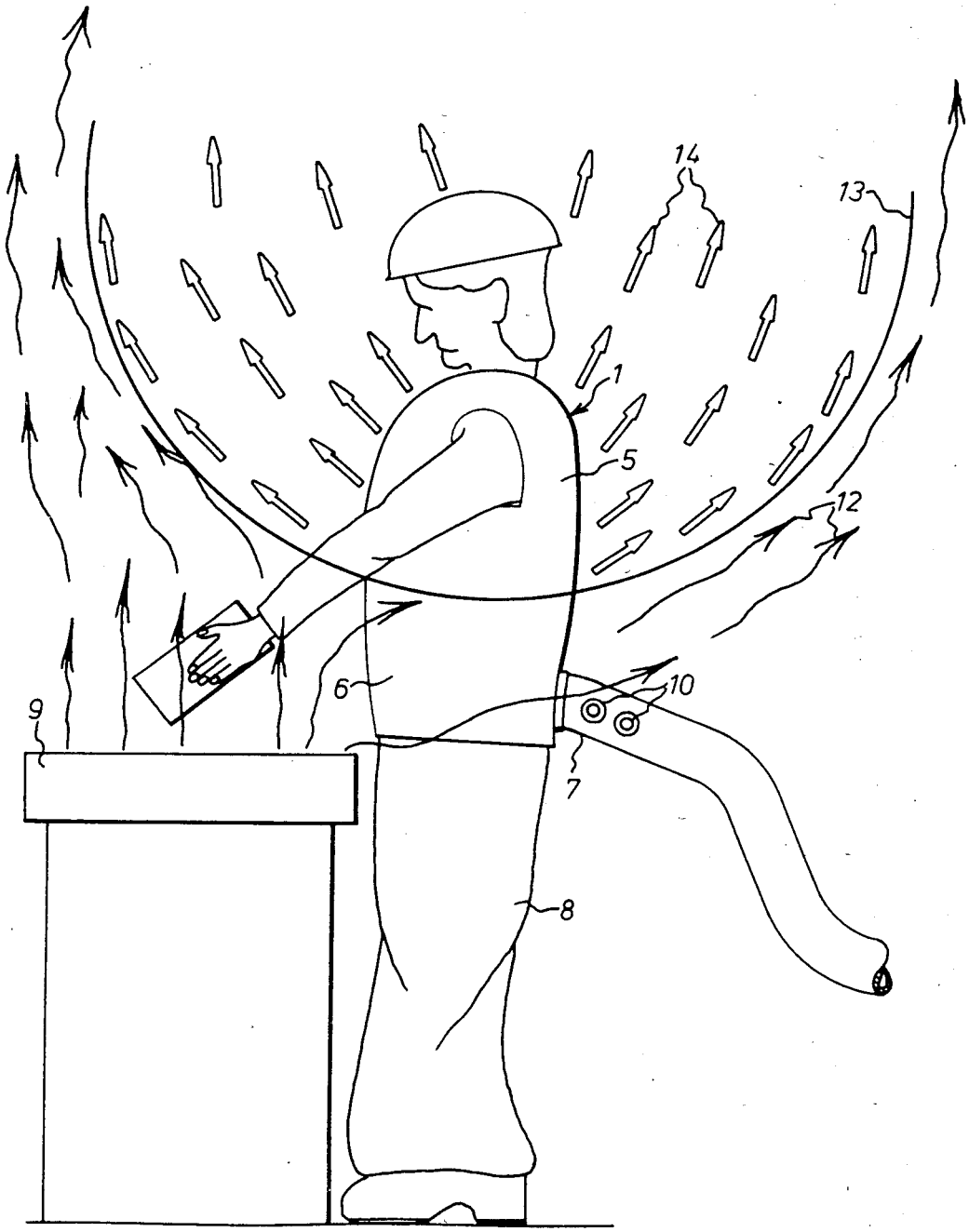
FIG. 3 illustrates the use of the vest at an ambient temperature which is approximately equal to or higher than the fresh air temperature.

FIGS. 2 and 3 illustrate the use of the vest in two different climates, FIG. 2 showing a climate where the temperature is between +16° and +23° C., while FIG. 3 shows a climate where the temperature is between +25 and +35° C., which frequently are the winter and summer temperatures, respectively, in factory premises.

In a test made with this invention, the vest was manufactured from tubular woven fabric of the type NORDIFA® which, at suitable places, had been treated with impermeable paint.

The vest has been designed to function at excess pressures of about 400–1800 Pa. The air supply is obtained from a unit (not shown) which is connected to the air supply connection 7 via a hose. The unit comprises a variable radial fan having a single-phase motor which provides a pressure increase of about 2,000 Pa and an air flow of about 40–100 liters per second, an air filter and an electric battery. The air flow and the temperature are controlled by means of knobs 10 on the air supply connection.

FIG. 2 illustrates the creation of a fresh air zone 13 around the wearer 8, which zone is formed of air supply 14 having a temperature of +24° C., a temperature which is considered agreeable in the context. Actually, the temperature and the flow rate of the supply air are selected on the basis of the natural convection of the human body. The temperature of the air 12 polluted with poisonous gases or dust is lower than +22° C., and the air supply 14 rises from the vest due to the excess temperature and forms the fresh air zone 13. It is possible in this case to maintain a relatively low air supply flow rate, which is advantageous because the wearer need not be irritated by strong air currents.

FIG. 3 illustrates a case where the temperature in the premises is higher than +22° C. The rising power of the air supply 14 is reduced because the temperature difference between the supply air and the ambient air is reduced, for which reason the air supply flow is increased. Since the temperature in the premises in this case is higher, the wearer can accept increased air movements without feeling uncomfortable.

The vest according to the present invention is well suited for the manufacture of plastic boats, for instance for work on the hull, other plastic industries, spray-painting plants, chemical industries, industries giving off dust or other air-borne particles, and temporary jobs, such as building sites, where use is made of hand tools with local extraction and where substitute air is nowadays required to maintain the dust content in the breathing zone at an acceptable value.

What I claim and desire to secure by Letters Patent is:

1. A vest for use in a polluted atmosphere, comprising:

(a) an air-permeable portion located at the upper part of the vest;

(b) an air-tight portion located in the lower part of the vest to form an air distribution zone; and (c) an air supply connection connected to the lower part of the vest for supplying fresh air to the air distribution zone and out throught said air-permeable portion, wherein a fresh air zone is formed outside the vest.

2. The vest as claimed in claim 1, further comprising:

(a) an outer layer; and (b) an inner layer, wherein said outer layer includes the air-permeable portion and the air supply connection, and said inner layer has a low permeability to air.

3. The vest as claimed in claim 2, wherein the air-tight portion is arranged in the outer layer and the air distribution zone is formed between the inner layer and the air-tight portion.

4. The vest as claimed in claim 3, wherein the air supply connection comprises:

means for controlling the air flow and the temperature of the fresh air.

* * * * *